US010227708B2

(12) United States Patent
Curran

(10) Patent No.: US 10,227,708 B2
(45) Date of Patent: Mar. 12, 2019

(54) SYSTEMS AND METHODS FOR CLEANING MEDICAL DEVICE ELECTRODES

(71) Applicant: St. Jude Medical, Cardiology Division, Inc., St. Paul, MN (US)

(72) Inventor: Timothy G. Curran, Ramsey, MN (US)

(73) Assignee: St. Jude Medical, Cardiology Division, Inc., St. Paul, MN (US)

( * ) Notice: Subject to any disclaimer, the term of this patent is extended or adjusted under 35 U.S.C. 154(b) by 640 days.

(21) Appl. No.: 14/877,002

(22) Filed: Oct. 7, 2015

(65) Prior Publication Data

US 2016/0143694 A1 May 26, 2016

Related U.S. Application Data

(60) Provisional application No. 62/081,087, filed on Nov. 18, 2014.

(51) Int. Cl.

| | |
|---|---|
| ***C25F 1/00*** | (2006.01) |
| ***C25F 1/02*** | (2006.01) |
| ***C25F 7/00*** | (2006.01) |

(52) U.S. Cl.

CPC ..... *C25F 1/02* (2013.01); *C25F 1/00* (2013.01); *C25F 7/00* (2013.01)

(58) Field of Classification Search

CPC ..... C25F 1/00–1/08; C25F 7/00

See application file for complete search history.

(56) References Cited

U.S. PATENT DOCUMENTS

| | | | | |
|---|---|---|---|---|
| 3,616,346 | A | 10/1971 | Inoue | |
| 4,795,537 | A * | 1/1989 | Timewell | C25B 1/04 204/229.5 |
| 6,233,476 | B1 | 5/2001 | Strommer et al. | |
| 6,402,931 | B1 | 6/2002 | Zhou et al. | |
| 6,498,944 | B1 | 12/2002 | Ben-Haim et al. | |
| 6,690,693 | B1 | 2/2004 | Crowder | |
| 6,733,656 | B2 | 5/2004 | Chalyt et al. | |
| 6,788,967 | B2 | 9/2004 | Ben-Haim et al. | |
| 7,153,411 | B2 | 12/2006 | Larson et al. | |
| 7,197,354 | B2 | 3/2007 | Sobe | |
| 7,263,397 | B2 | 8/2007 | Hauck et al. | |
| 7,386,339 | B2 | 6/2008 | Strommer et al. | |
| 2004/0004006 | A1 | 1/2004 | Taylor et al. | |
| 2005/0067289 | A1 * | 3/2005 | Noji | C25F 7/00 205/83 |

(Continued)

FOREIGN PATENT DOCUMENTS

WO 2005/066395 7/2005

OTHER PUBLICATIONS

"The Electrolysis of Aqueous NaCl", from Electrolytic Cells, retrieved Feb. 10, 2016 from http://chemed.chem.purdue.edu/genchem/topicreview/bp/ch20/faraday.php#aq.

*Primary Examiner* — Nicholas A Smith

(74) *Attorney, Agent, or Firm* — Armstrong Teasdale LLP

(57) ABSTRACT

An electrode cleaning system includes a medical device including a plurality of electrodes, a fluid reservoir including an electrolytic solution, and a cleaning device. The cleaning device is electrically coupled to the medical device, and is configured to channel a DC current between at least one pair of electrodes of the plurality of electrodes when the plurality of electrodes are submerged in the fluid reservoir.

20 Claims, 5 Drawing Sheets

(56) References Cited

U.S. PATENT DOCUMENTS

| | | | | |
|---|---|---|---|---|
| 2005/0224367 | A1 | 10/2005 | Kortvelyessy et al. | |
| 2007/0125661 | A1* | 6/2007 | Wang | B23H 5/08 205/651 |
| 2008/0070803 | A1 | 3/2008 | Egeland | |
| 2008/0255647 | A1* | 10/2008 | Jensen | A61N 1/05 607/119 |
| 2010/0072073 | A1 | 3/2010 | Jabado et al. | |
| 2012/0048741 | A1* | 3/2012 | Stewart | C02F 1/4674 205/337 |

* cited by examiner

SYSTEMS AND METHODS FOR CLEANING MEDICAL DEVICE ELECTRODES

This application claims priority to U.S. Provisional Patent Application No. 62/081,087, filed Nov. 18, 2014, entitled "SYSTEMS AND METHODS FOR CLEANING MEDICAL DEVICE ELECTRODES," the disclosure of which is hereby incorporated by reference in its entirety.

FIELD OF THE DISCLOSURE

The present disclosure relates generally to medical devices including electrodes, and more particularly to systems and methods for cleaning catheter electrodes.

BACKGROUND ART

Catheters including electrodes, such as cardiac catheters, are sterile devices. However, electrode surfaces may not be completely clean at all times. For example, manufacturing residues or oxides may form on an electrode surface, resulting in poor electrogram rendering. Additionally, modeling systems may generate distorted models if sensor electrodes are unclean.

Accordingly, electro-cleaning, or electro-polishing, may be used to clean electrode surfaces to improve electrograms and reduce modeling distortion. At least some known cleaning systems submerge an electrode to be cleaned in an industrial bath (e.g., a phosphoric, sulphuric, or nitric acid bath), and conduct a current between the electrode to be cleaned and a separate, sacrificial anode/cathode located in the bath.

Further, this cleaning is typically done prior to package for sterilization purposes, and sterilization procedures applied after the cleaning may leave a residual material layer on electrodes. Finally, at least some known cleaning systems are utilized in an industrial setting, and are not feasible or available for use in a clinical setting (e.g., immediately prior to use with a patient).

BRIEF SUMMARY OF THE DISCLOSURE

In one embodiment, the present disclosure is directed to an electrode cleaning system. The electrode cleaning system includes a medical device including a plurality of electrodes, a fluid reservoir including an electrolytic solution, and a cleaning device electrically coupled to the medical device, the cleaning device configured to channel a DC current between at least one pair of electrodes of the plurality of electrodes when the plurality of electrodes are submerged in the fluid reservoir.

In another embodiment, the present disclosure is directed to a cleaning device configured to electrically couple to a medical device having a plurality of electrodes. The cleaning device includes at least one current source configured to generate a DC current, and a plurality of switches operable to channel the DC current between at least one pair of electrodes of the plurality of electrodes when the plurality of electrodes are submerged in a fluid reservoir including an electrolytic solution.

In another embodiment, the present disclosure is directed to a method for cleaning a plurality of electrodes. The method includes electrically coupling a cleaning device to a medical device including the plurality of electrodes, submerging the plurality of electrodes in a fluid reservoir including an electrolytic solution, and channeling, using the cleaning device, a DC current between at least one pair of electrodes of the plurality of electrodes.

The foregoing and other aspects, features, details, utilities and advantages of the present disclosure will be apparent from reading the following description and claims, and from reviewing the accompanying drawings.

DETAILED DESCRIPTION OF THE DISCLOSURE

The present disclosure provides systems and methods for cleaning electrodes on a medical device (e.g., a catheter). An electrode cleaning system includes a medical device including a plurality of electrodes, a fluid reservoir, and a cleaning device. The cleaning device is electrically coupled to the medical device, and is configured to channel a DC current between at least one pair of electrodes of the plurality of electrodes when the plurality of electrodes are submerged in the fluid reservoir.

Figure 1:
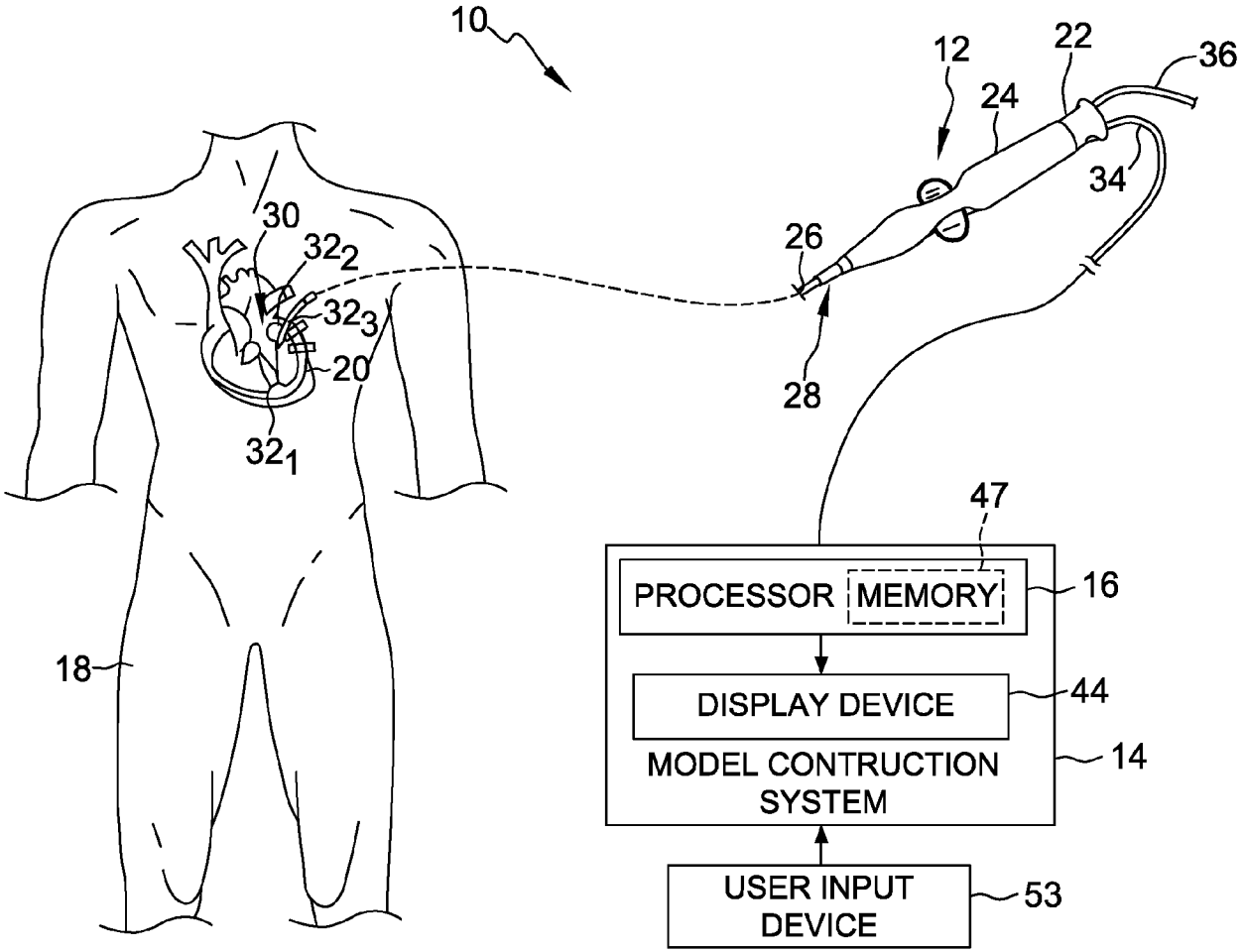
FIG. 1 is a diagrammatic view of a system for generating a multi-dimensional surface model of a geometric structure according to one embodiment.

Referring now to the drawings wherein like reference numerals are used to identify identical components in the various views, FIG. 1 illustrates one exemplary embodiment of a system 10 for generating a multi-dimensional surface model of one or more geometric structures. It should be noted that while the following description focuses on the use of system 10 in the generation of models of anatomic structures, and cardiac structures in particular, the present disclosure is not meant to be so limited. Rather, system 10 may be applied to the generation of three-dimensional models of any number of geometric structures, including anatomic structures other than cardiac structures.

With continued reference to FIG. 1, in this embodiment, the system 10 includes, among other components, a medical device and a model construction system 14. In this embodiment, medical device is a catheter 12, and model construction system 14 includes, in part, a processing apparatus 16. Processing apparatus 16 may take the form of an electronic control unit, for example, that is configured to construct a three-dimensional model of structures within the heart using data collected by catheter 12. Those of skill in the art will appreciate that, although the embodiments described herein relate to cleaning electrodes on a catheter, the systems and methods described herein may be utilized to clean electrodes on any suitable device.

As illustrated in FIG. 1, catheter 12 is configured to be inserted into a patient's body 18, and more particularly, into the patient's heart 20. Catheter 12 may include a cable connector or interface 22, a handle 24, a shaft 26 having a proximal end 28 and a distal end 30 (as used herein, "proximal" refers to a direction toward the portion of the catheter 12 near the clinician, and "distal" refers to a direction away from the clinician and (generally) inside the body of a patient), and one or more sensors 32 (e.g., $32_1$, $32_2$, $32_3$) mounted in or on shaft 26 of catheter 12. In this embodiment, sensors 32 are disposed at or near distal end 30 of shaft 26. Catheter 12 may further include other conventional components such as, for example and without limitation, a temperature sensor, additional sensors or electrodes, ablation elements (e.g., ablation tip electrodes for delivering RF ablative energy, high intensity focused ultrasound ablation elements, etc.), and corresponding conductors or leads.

Connector 22 provides mechanical, fluid, and electrical connection(s) for cables, such as, for example, cables 34, 36 extending to model construction system 14 and/or other components of system 10 (e.g., a visualization, navigation, and/or mapping system (if separate and distinct from model construction system 14), an ablation generator, irrigation source, etc.). Connector 22 is disposed at proximal end 28 of catheter 12, and handle 24 thereof, in particular.

Handle 24 provides a location for the clinician to hold catheter 12 and may further provide means for steering or guiding shaft 26 within body 18 of the patient. Shaft 26 is an elongate, tubular, flexible member configured for movement within body 18. Shaft 26 supports, for example and without limitation, sensors and/or electrodes mounted thereon, such as, for example, sensors 32, associated conductors, and possibly additional electronics used for signal processing and conditioning.

Sensors 32 mounted in or on shaft 26 of catheter 12 may be provided for a variety of diagnostic and therapeutic purposes including, for example and without limitation, electrophysiological studies, pacing, cardiac mapping, and ablation. In this embodiment, one or more of sensors 32 are provided to perform a location or position sensing function. Accordingly, as catheter 12 is moved along a surface of a structure of interest of heart 20 and/or about the interior of the structure, sensor(s) 32 can be used to collect location data points that correspond to the surface of, and/or other locations within, the structure of interest.

Model construction system 14 is configured to function with sensor(s) 32 to collect location data points that are used in the construction of a three-dimensional model. Model construction system 14 may comprise an electric field-based system, such as, for example, the EnSite™ NavX™ system commercially available from St. Jude Medical, Inc., and generally shown with reference to U.S. Pat. No. 7,263,397 entitled "Method and Apparatus for Catheter Navigation and Location and Mapping in the Heart", the entire disclosure of which is incorporated herein by reference. In other embodiments, however, model construction system 14 may comprise other types of systems, such as, for example and without limitation: a magnetic-field based system such as the Carto™ System available from Biosense Webster, and as generally shown with reference to one or more of U.S. Pat. No. 6,498,944 entitled "Intrabody Measurement," U.S. Pat. No. 6,788,967 entitled "Medical Diagnosis, Treatment and Imaging Systems," and U.S. Pat. No. 6,690,963 entitled "System and Method for Determining the Location and Orientation of an Invasive Medical Instrument," the entire disclosures of which are incorporated herein by reference, or the gMPS system from MediGuide Ltd., and as generally shown with reference to one or more of U.S. Pat. No. 6,233,476 entitled "Medical Positioning System," U.S. Pat. No. 7,197,354 entitled "System for Determining the Position and Orientation of a Catheter," and U.S. Pat. No. 7,386,339 entitled "Medical Imaging and Navigation System," the entire disclosures of which are incorporated herein by reference; a combination electric field-based and magnetic field-based system such as the Carto 3™ System also available from Biosense Webster; as well as other impedance-based localization systems. As briefly described above, sensor(s) 32 of catheter 12 include positioning sensors. Sensor(s) 32 produce signals indicative of catheter location (position and/or orientation) information. In this embodiment, wherein model construction system 14 is an electric field-based system, sensor(s) 32 comprise one or more electrodes (not shown in FIG. 1).

Figure 2:
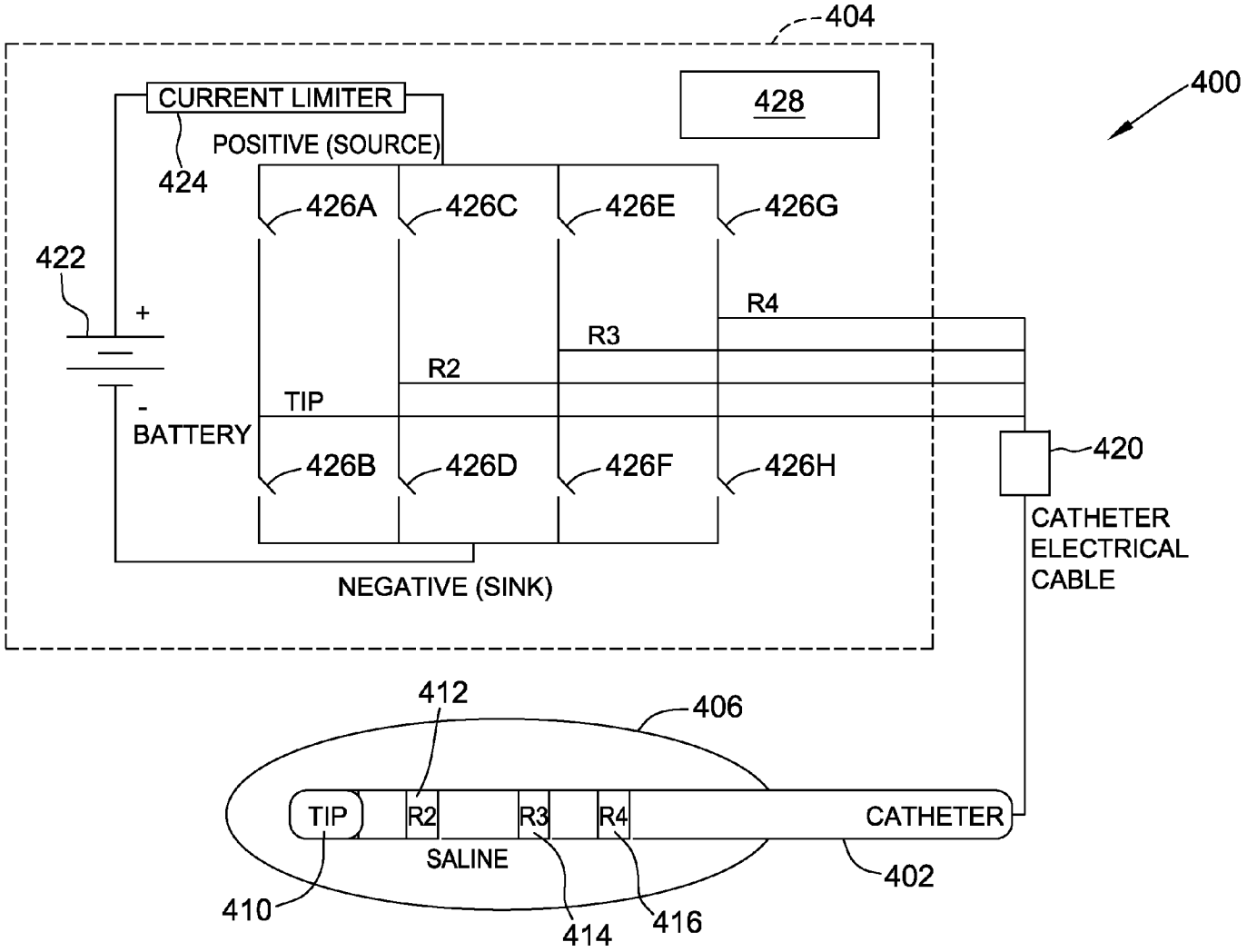
FIG. 2 is a schematic view of one embodiment of a system for cleaning catheter electrodes.

In FIG. 2, a system for cleaning catheter electrodes is indicated generally at 400. System 400 may be used to clean electrodes, for example, in modeling system 10 (shown in FIG. 1) and/or systems including catheter electrodes. System 400 includes a catheter 402, a cleaning device 404, and saline reservoir 406. Catheter 402 may be, for example, catheter 12 (shown in FIG. 1).

Saline reservoir 406 may be, for example, a relatively shallow dish or beaker of sterile saline. Although saline (i.e., sterile sodium chloride) is used in this embodiment, alternatively, reservoir 406 may include other electrolyte solutions (e.g., mild alkaline solutions such as sodium carbonate). As shown in FIG. 2, in this embodiment, catheter 402 includes four electrodes: a tip electrode 410 ("TIP"), a second electrode 412 ("R2"), a third electrode 414 ("R3"), and a fourth electrode 416 ("R4"). Alternatively, catheter 402 may include any number and configuration of electrodes that enables system 400 to function as described herein, with the programming of cleaning device 404 modified accordingly. Catheter 402 is inserted into saline reservoir 406 such that electrodes 410, 412, 414, and 416 are submerged in saline. In this embodiment, electrodes 410, 412, 414, and 416 are inert materials (e.g., platinum or stainless steel) such that there is no dissolution of these materials by low-voltage electrolysis.

Catheter 402 is electrically connected to cleaning device 404 at a connector 420. For example, cleaning device 404 may include a cable that engages a corresponding socket on catheter 402. In this embodiment, cleaning device 404 is a relatively small, portable, hand-held device that is selectively coupleable to catheter 402. Further, to facilitate portability, cleaning device 404 may be battery operated. Alternatively, cleaning device 404 may have any size and/or configuration that enables system 400 to function as described herein.

In this embodiment, cleaning device 404 includes a battery 422 electrically coupled in series with a current limiter 424. Battery 422 is configured to deliver an electric current from approximately 1 milliamp (mA) to 50 mA of direct current (DC) and may be, for example, a 9 V battery. In this embodiment, current limiter 424 limits current to approximately 20 mA.

As shown in FIG. 2, cleaning device 404 includes a plurality of switches 426A-426H that selectively control the flow of the current generated by battery 422 between electrodes 410, 412, 414, and 416. For example, if a first switch 426A and a second switch 426D are closed, current will flow from tip electrode 410 to second electrode 412. Although this embodiment includes eight switches 426A-426H, in other embodiments, the number of switches may differ depending on the configuration of the catheter (i.e., a greater or lesser number of switches may be provided based on the number of electrodes on the catheter). A state of each switch 426A-426H (i.e., open or closed) may be controlled by a processing device 428 (e.g., a microprocessor) included in cleaning device 404. Processing device 428 may be activated by a user manipulating a start switch or other input device.

In some embodiments, processing device 428 cycles the states of switches 426A-426H through a predetermined pattern automatically. For example, cleaning device 404 may initially direct current through a first pair of electrodes, and then manipulate switches 426A-426H to direct current through a second pair of electrodes after a predetermined time (e.g., in a range from approximately 10 seconds to 30 seconds). Alternatively, the processing device may control the states of switches 426A-426H based on user input received at cleaning device 404 (e.g., from a toggle switch, dial, button, and/or other input device). Further, in other embodiments, switches 426A-426H may be controlled with a mechanical switching device (not shown), such as a double pole rotary switch. Other suitable types of mechanical and/or electrical switching devise are also contemplated.

As will be appreciated by those of skill in the art, channeling DC current between a pair of electrodes facilitates cleaning those electrodes using electro-cleaning, or electro-polishing. Each electrode may function as a cathode or anode, depending on the direction of current flow. Because the current flows between a pair of electrodes on catheter 402, a separate bath electrode is not required. This makes maintaining sterility relatively easy, as it avoids introducing a separate bath electrode with its own sterility requirements.

In some embodiments, to facilitate equal cleaning of each electrode, for a given pair of electrodes, the current initially flows between the electrodes in a first direction for a first period of time, and then switches 426A-426H are manipulated such that the current flows between the same electrodes in a second, opposite direction for a second period of time. Further, saline reservoir 406 may be flushed with electrolytes during the cleaning process to improve cleaning.

In one example, a sample cleaning process (e.g., controlled by processing device 428) is as follows. Initially, switches 426A and 426D are closed for a first period of time to allow current to flow from tip electrode 410 to second electrode 412. Then, switches 426A and 426D are opened, and switches 426C and 426B are closed for a second period of time to allow current to flow from second electrode 412 to tip electrode 410. Subsequently, switches 426C and 426B are opened, and switches 426E and 426H are closed for a third period of time to allow current to flow from third electrode 414 to fourth electrode 416. Finally, switches 426E and 426H are opened, and switches 426G and 426F are closed for a fourth period of time to allow current to flow from fourth electrode 416 to third electrode 414. Those of skill in the art will appreciate that there are many possible variations on the pattern for the cleaning process.

The current flow instantiates electrolysis, causing relatively small gas bubbles to form on the electrodes. Generally, in saline reservoir 406, hydrogen ($H_2$) will form on the negative electrode of the pair, and oxygen ($O_2$) will form on the positive electrode of the pair. The amounts of $H_2$ and $O_2$ generated are relatively small, and the voltage required to generate the current is also relatively small.

Figure 3:
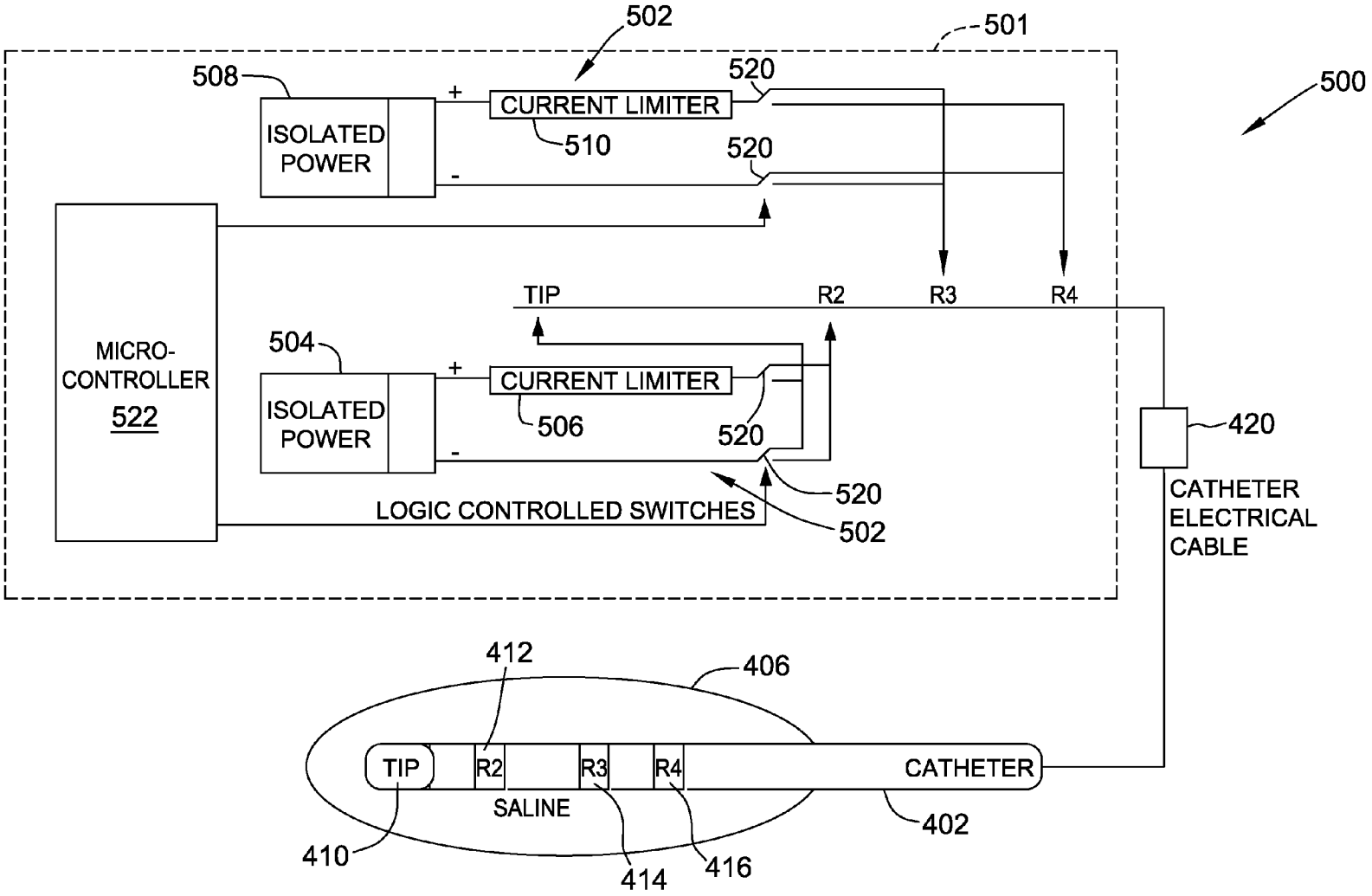
FIG. 3 is a schematic view of an alternative embodiment of a system for cleaning catheter electrodes.

FIG. 3 is a schematic diagram of an alternative system 500 for cleaning catheter electrodes. Unless otherwise indicated, components of system 500 are substantially identical to those of system 400. As shown in FIG. 3, a cleaning device 501 includes two dedicated and isolated current sources 502, one for each pair of electrodes. Specifically, a first power supply 504 and a first current limiter 506 channel current through tip electrode 410 and second electrode 412, and a second power supply 508 and a second current limiter 510 channel current through third electrode 414 and fourth electrode 416. Similar to system 400, switches 520 control the direction of current flow, and a microcontroller 522 controls the state of switches 520. Because of the isolated current sources 502, both pairs of electrodes may be cleaned simultaneously, reducing the overall time required to clean electrodes 410, 412, 414, and 416. In contrast, under the architecture of system 400, only one electrode pair may be cleaned at a time.

Figure 4:
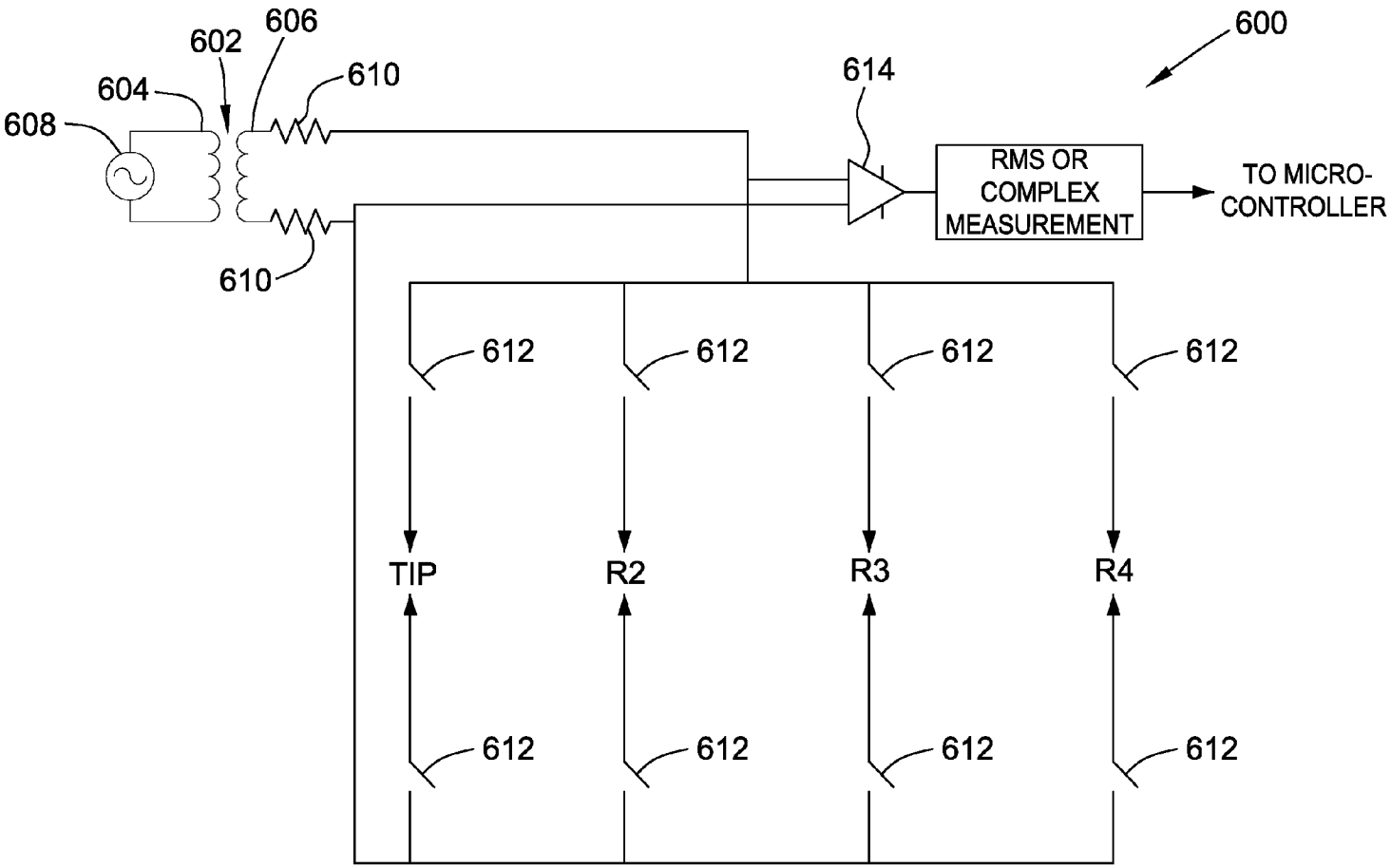
FIG. 4 is a schematic view of one embodiment of an impedance measurement circuit that may be used with the systems shown in FIGS. 2 and 3.

FIG. 4 is a schematic diagram of one embodiment of an impedance measurement circuit 600 that may be used with system 400 (shown in FIG. 2) or system 500 (shown in FIG. 3). Impedance measurement circuit 600 may be included within cleaning device 404 or cleaning device 501. Measuring impedances at electrodes 410, 412, 414, and 416 facilitates determining when electrodes 410, 412, 414, and 416 are clean, and verifying that catheter 402 is not in-vivo when the cleaning process begins, as described herein.

Impedance measurement circuit 600 includes an isolation transformer 602 that has a primary side 604 and a secondary side 606 and may have a turns ratio of, for example, 1:1. Primary side 604 is coupled to an AC voltage source 608. AC voltage source 608 may be, for example a 10 kilohertz (kHz) 1 volt source. Secondary side 606 is coupled to a pair of resistors 610. In this embodiment, resistors 610 have relatively high resistance values on the order of 50 kilo ohms each. The relatively high resistance values limit current to a safe value (e.g., 10 micro amps AC), and the current remains essentially constant over the impedance measuring range.

In this embodiment, impedance measurement circuit 600 includes a plurality of switches 612 that enable selectively measuring the impedance between electrodes 410, 412, 414, and 416. Specifically, an amplifier 614 facilitates measuring the impedance as a root mean square value and/or a complex impedance value. In some embodiments, the measured impedance is provided to the processing device/microcontroller of cleaning device 404 or cleaning device 501.

As electrodes 410, 412, 414, and 416 are cleaned, the impedance between electrodes will decrease until it reaches a terminal value. The terminal value depends on salinity of saline reservoir 406, dimensions of electrodes 410, 412, 414, and 416, and an ambient temperature. Depending on the size and spacing of electrodes 410, 412, 414, and 416, the terminal value may be, for example, on the order of 50 to 150 ohms. In one embodiment, the processing device/microcontroller monitors the measured impedance values to determine when the terminal value is reached for electrodes 410, 412, 414, and 416. Because injection grade saline is highly standardized, saline conductivity may be measured quantitatively to determine when the terminal value is reached. Saline conductivity does vary with temperature, however. Accordingly, to improve accuracy, in some embodiments, cleaning device 404/501 receives a temperature measurement (e.g., the temperature of saline reservoir 406) from a temperature sensor (not shown) in catheter 402, and uses that temperature measurement to normalize the impedance measurements and determine the terminal value.

Once the terminal value is reached for each electrode 410, 412, 414, and 416, the processing device/microcontroller may generate an alert to notify the user that the cleaning process is complete. For example, the processing device/microcontroller may generate an audible alarm, activate an indicator light, and/or display a notification on a display device (not shown) to notify the user.

As noted above, impedance measurement circuit 600 also facilitates verifying that catheter 402 is not in-vivo when the cleaning process is instantiated. Because of the bubbles generated during the cleaning process, it is important catheter 402 not be in-vivo during the cleaning process. Accordingly, in some embodiments, before initiating the cleaning process, cleaning device 404 or 501 requires the user to hold catheter 402 in the air to verify a relatively high initial impedance between electrodes 410, 412, 414, and 416. If a relatively high initial impedance (e.g., above a predetermined threshold impedance) is not detected shortly before the user attempts to initiate the cleaning process (e.g., 10-15 seconds before), cleaning device 404 or 501 prohibits the cleaning process from initializing. Notably, impedance measurement circuit 600 uses a relatively low current (on the order of microamps) for the verification, and accordingly, is safe for in-vivo use.

Figure 5:
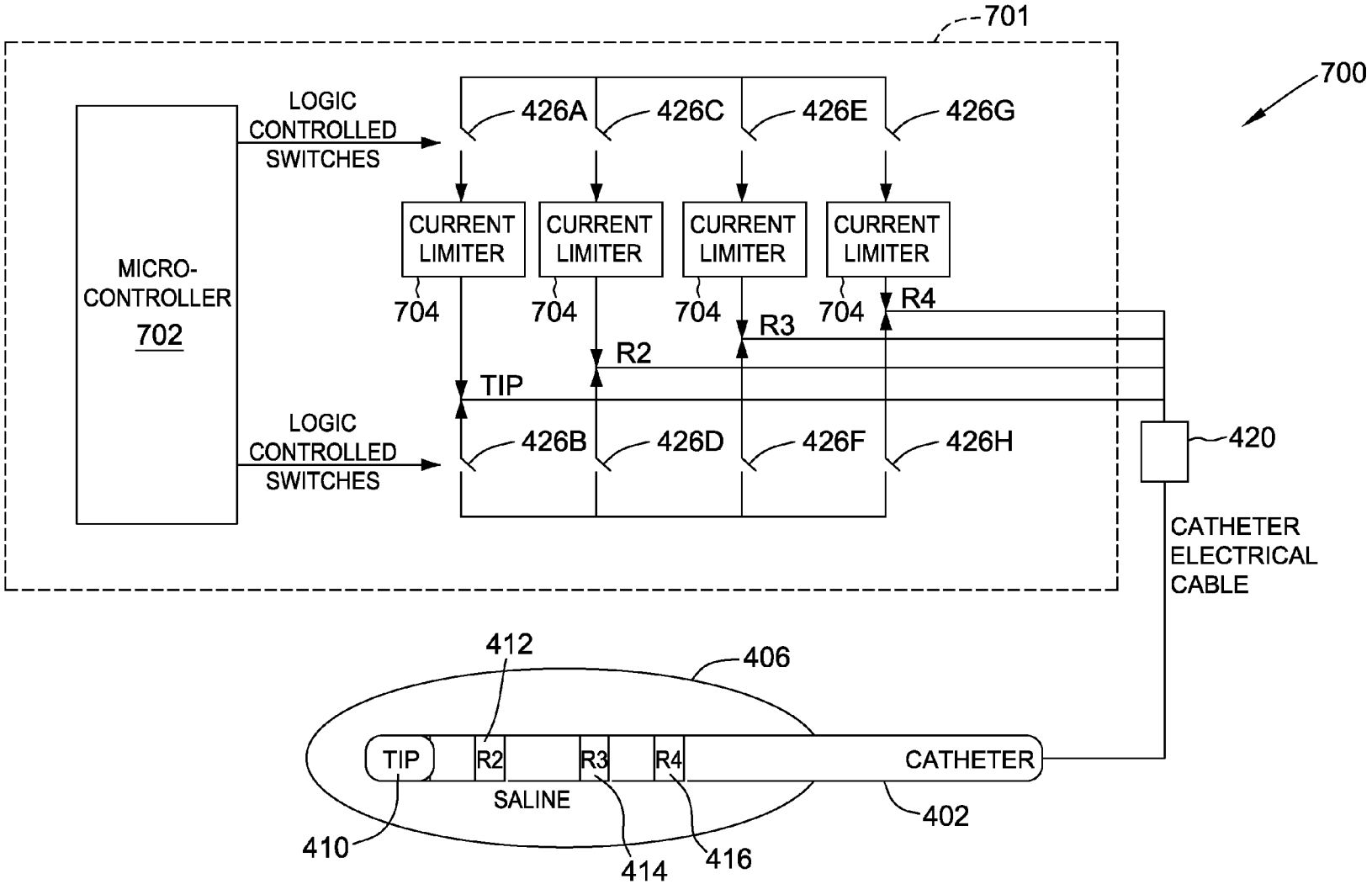
FIG. 5 is a schematic view of an alternative embodiment of a system for cleaning catheter electrodes.

FIG. 5 is a schematic diagram of an alternative system 700 for cleaning catheter electrodes. Unless otherwise indicated, components of system 700 are substantially identical to those of system 400. As shown in FIG. 5, a cleaning device 701 includes a microcontroller 702 that controls operation of switches 426A-426H. Further, cleaning device 701 includes a set of current limiters 704 associated with each of electrodes 410, 412, 414, and 416 (a power source for current limiters 704 is not shown). This configuration allows for multiple electrodes to source current while one electrode provides a sink path. This may be particularly useful, for example, when one electrode is much larger than the others. Current limiters 704 may be set to, for example, 20 mA. The larger electrode sinks the sum of the smaller electrode currents but because of its larger surface area may actually experience roughly equal current density at its surface as the small electrodes. This allows for uniform cleaning of electrodes despite surface area differences.

Microcontrollers 522 and 702 may include one or more processing units (e.g., in a multi-core configuration). Further, microcontrollers 522 and 702 may be implemented using one or more heterogeneous processor systems in which a main processor is present with secondary processors on a single chip. In another illustrative example, microcontrollers 522 and 702 may be a symmetric multi-processor system containing multiple processors of the same type. Further, microcontrollers 522 and 702 may be implemented using any suitable programmable circuit including one or more systems, microprocessors, reduced instruction set circuits (RISC), application specific integrated circuits (ASIC), programmable logic circuits, field programmable gate arrays (FPGA), and any other circuit capable of executing the functions described herein.

The systems and methods described herein facilitate cleaning electrodes on a medical device (e.g., a catheter). A cleaning device is electrically coupled to a medical device including a plurality of electrodes. The plurality of electrodes are submerged in a reservoir, and the cleaning device channels a direct current between pair of the plurality of electrodes. Notably, the systems and methods described herein may be utilized in a clinical setting where sterility must be maintained, just prior to using the medical device with a patient or subject.

Although certain embodiments of this disclosure have been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the disclosure. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the disclosure as defined in the appended claims.

When introducing elements of the present disclosure or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions without departing from the scope of the disclosure, it is intended that all matter contained in the above description or shown in the accompanying drawings shall be interpreted as illustrative and not in a limiting sense.

What is claimed is:

1. An electrode cleaning system comprising:

a medical device comprising a plurality of electrodes and an electrical cable;

a fluid reservoir comprising an electrolytic solution;

a cleaning device comprising switching circuitry; and a connector electrically coupling the cleaning device to the medical device, the connector providing an interface between the electrical cable and the switching circuitry of the cleaning device, the cleaning device configured to channel a DC current between at least one pair of electrodes of the plurality of electrodes when the plurality of electrodes of the medical device are submerged in the fluid reservoir.

2. The electrode cleaning system of claim 1, wherein the cleaning device is configured to:

channel the DC current between the at least one pair of electrodes in a first direction for a first period of time; and channel the DC current between the at least one pair of electrodes in a second direction for a second period of time, wherein the second direction is opposite from the first direction.

3. The electrode cleaning system of claim 1, wherein the fluid reservoir is a saline reservoir.

4. The electrode cleaning system of claim 1, wherein the medical device is a catheter configured for use in a cardiac mapping or modeling system.

5. The electrode cleaning system of claim 1, wherein the cleaning device further comprises an impedance measurement circuit configured to measure impedances between the plurality of electrodes.

6. The electrode cleaning system of claim 5, wherein the impedance measurement further circuit is further configured to:

measure a temperature of the electrolytic solution; and normalize the measured impedances based on the measured temperature.

7. The electrode cleaning system of claim 5, wherein the cleaning device further comprises a processing device communicatively coupled to the impedance measurement circuit, the processing device configured to verify whether or not the medical device is currently in-vivo based on measurements acquired by the impedance measurement circuit.

8. The electrode cleaning system of claim 5, wherein the cleaning device further comprises a processing device communicatively coupled to the impedance measurement circuit, the processing device configured to determine whether or not the at least one pair of electrodes is substantially clean based on measurements acquired by the impedance measurement circuit.

9. A cleaning device configured to electrically couple to a medical device having a plurality of electrodes, the cleaning device comprising:

at least one current source configured to generate a DC current;

a plurality of switches operable to channel the DC current between at least one pair of electrodes of the plurality of electrodes when the plurality of electrodes are submerged in a fluid reservoir including an electrolytic solution; and a processing device configured to determine whether or not the at least one pair of electrodes is substantially clean, and configured to generate an alert upon a determination that the at least one pair of electrodes is substantially clean, wherein the alert includes at least one of an audible alarm, activation of an indicator light, and display of a notification stating a cleaning process is complete.

10. The cleaning device of claim 9, wherein the at least one current source comprises:

a first current source configured to generate a first DC current to be channeled between a first pair of electrodes of the at least one pair of electrodes; and a second current source configured to generate a second DC current to be channeled between a second pair of electrodes of the at least one pair of electrodes.

11. The cleaning device of claim 9, wherein the cleaning device is configured to:

channel the DC current between the at least one pair of electrodes in a first direction for a first period of time; and channel the DC current between the at least one pair of electrodes in a second direction for a second period of time, wherein the second direction is opposite from the first direction.

12. The cleaning device of claim 9 further comprising an impedance measurement circuit configured to measure impedances between the plurality of electrodes.

13. The cleaning device of claim 12 wherein the processing device is communicatively coupled to the impedance measurement circuit, the processing device configured to verify whether or not the medical device is currently in-vivo based on measurements acquired by the impedance measurement circuit.

14. The cleaning device of claim 12 wherein the processing device communicatively coupled to the impedance measurement circuit, the processing device configured to determine whether or not the at least one pair of electrodes is substantially clean based on measurements acquired by the impedance measurement circuit.

15. The cleaning device of claim 9, wherein the cleaning device is a portable, handheld device.

16. A method for cleaning a plurality of electrodes, the method comprising:

electrically coupling a cleaning device to a medical device including the plurality of electrodes;

submerging the plurality of electrodes in a fluid reservoir including an electrolytic solution; and channeling, using the cleaning device, a DC current between at least one pair of electrodes of the plurality of electrodes.

17. The method of claim 16, wherein channeling a DC current comprises:

channeling the DC current between the at least one pair of electrodes in a first direction for a first period of time; and channeling the DC current between the at least one pair of electrodes in a second direction for a second period of time, wherein the second direction is opposite from the first direction.

18. The method of claim 16, further comprising measuring impedances between the plurality of electrodes using an impedance measurement circuit included within the cleaning device.

19. The method of claim 18, further comprising:

measuring a temperature of the electrolytic solution; and normalizing the measured impedances based on the measured temperature.

20. The method of claim 16, wherein electrically coupling a cleaning device to a medical device comprises electrically coupling a portable, handheld cleaning device to the medical device.

* * * * *